US005882041A

United States Patent [19]

Schara

[11] Patent Number: 5,882,041

[45] Date of Patent: Mar. 16, 1999

[54] INTEGRATED CHECK REGISTER AND BUDGET REGISTER

[76] Inventor: William V. Schara, 3221 S. Rebecca, Spokane, Wash. 99223

[21] Appl. No.: 504,536

[22] Filed: Jul. 20, 1995

[51] Int. Cl.[6] ..... B42D 11/00; B42D 12/00

[52] U.S. Cl. ..... 283/66.1; 283/66.2; 283/64.1; 283/115; 283/57; 283/58; 462/53; 462/54; 462/81

[58] Field of Search ..... 283/57, 59, 58, 283/66.1, 64.1, 66.2, 115; 462/53, 75, 54, 81; 281/5

[56] References Cited

U.S. PATENT DOCUMENTS

| | | | |
|---|---|---|---|
| 2,470,586 | 5/1949 | Tathwell | 462/18 |
| 3,236,542 | 2/1966 | Russell, III | 462/81 |
| 3,269,753 | 8/1966 | DeRham et al. | 283/66.1 |
| 3,333,869 | 8/1967 | Alexander | 462/57 |
| 3,734,543 | 5/1973 | Donovan | 462/53 |
| 3,861,718 | 1/1975 | Strus . | |
| 3,901,537 | 8/1975 | Oldham | 462/27 |
| 4,002,356 | 1/1977 | Weidmann . | |
| 4,014,566 | 3/1977 | Cantrell et al. | 283/58 |
| 4,216,979 | 8/1980 | Janik | 283/58 |
| 4,225,157 | 9/1980 | Hamacher . | |
| 4,332,400 | 6/1982 | Hayman | 281/5 X |
| 4,346,917 | 8/1982 | Clancy | 283/58 |
| 4,392,675 | 7/1983 | Winiarski . | |
| 4,400,016 | 8/1983 | Tippets | 283/66.1 |
| 4,400,017 | 8/1983 | Pendergrass . | |
| 4,465,305 | 8/1984 | Bateman et al. | 283/58 X |
| 4,465,306 | 8/1984 | Hincks et al. | 281/45 |
| 4,489,958 | 12/1984 | Martin | 283/66.1 X |
| 4,810,866 | 3/1989 | Lord, Jr. . | |
| 5,188,562 | 2/1993 | Carley | 283/58 X |
| 5,251,936 | 10/1993 | Fitzgibbons . | |
| 5,258,935 | 11/1993 | Ure . | |

*Primary Examiner*—Frances Han

*Attorney, Agent, or Firm*—Wells, St. John, Roberts, Gregory & Matkin, P.S.

[57] ABSTRACT

Disclosed is an integrated check register and budget register for, among other purposes, the tracking of checks and the tracking of a budget or categorization of expenditures. The integrated register includes a plurality of data sheets longitudinally folded, with the fold forming two quadrants on each side or surface of the paper or data sheet. When adjacent data sheets are unfolded there are four quadrants, which when imprinted with check and budget register indicators, form an integrated check and budget register.

12 Claims, 15 Drawing Sheets

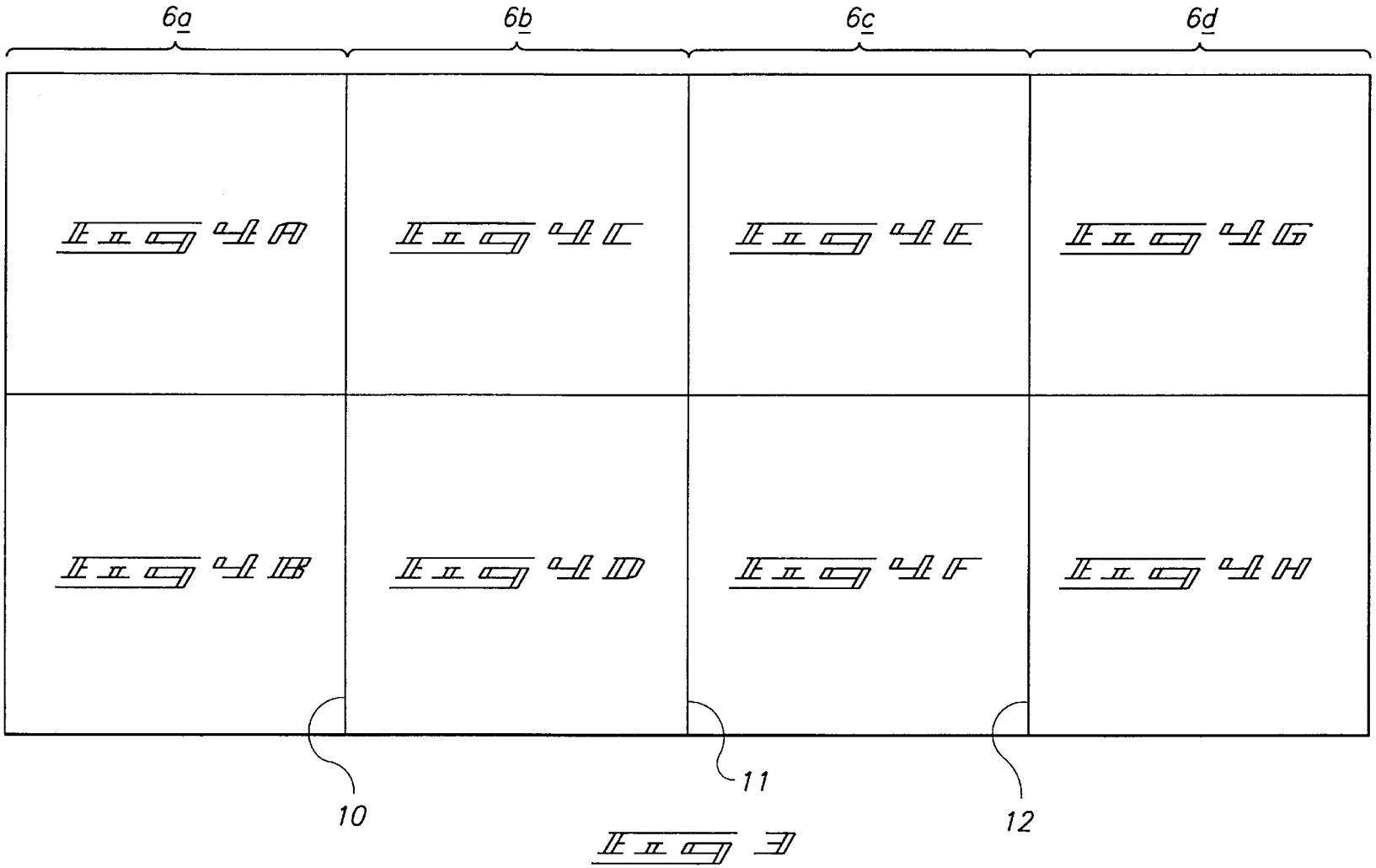
6a
6b
6c
6d
10
11
12
A
B
C
D
E
F
G
H

INTEGRATED CHECK REGISTER AND BUDGET REGISTER

TECHNICAL FIELD

This invention generally pertains to a bank or check register which includes an integrated budget register or journal.

BACKGROUND OF THE INVENTION

Check registers for personal checking accounts are generally sized to fit in one's pocket, purse, billfold or wallet, and are normally approximately three inches by six inches. FIG. 1 is a perspective view of a traditionally shaped check register 1, having a length 2, a width 3 and a height 4.

A typical check register has a number of columns for data entry, generally including: a column to enter the check or receipt number; a column to enter the date of the transaction; a column to enter the payee information and/or a description of the transaction; a column to enter the amount of withdrawal (if applicable); a column to enter a check mark or indicator; a column to enter a bank fee, if any; a column to enter data regarding the amount of a deposit; and a column to maintain a running or cumulative account balance.

Although many people desire to establish, maintain and follow a budget for their personal expenditures, few actually do. There are many reasons for this, namely: the time and inconvenience of establishing, maintaining and following a separate budget register; the time and inconvenience of manually going through the check register monthly or periodically and transferring figures from the checks previously written to the budget register; and the size and impracticality of carrying a larger sized budget register to enter other non-check data such as cash and credit card expenditures as they are incurred.

The need for simple, convenient and portable integrated check register and budget register has been recognized, but has not been adequately fulfilled by prior known machinery or methods.

A further need has been recognized for an integrated check register and budget register which a person can easily carry, similar to a conventional checkbook, but yet which makes it relatively easy not only to record checking and savings transactions, but also to maintain an ongoing budget register.

There is a still further need for a combined check register and budget register which contains all the budget categories on the same page to enable a viewer or user to see the entire budget at one time, and which also allows for easier reconciliation of the items and categories contained in the budget register. Having the combined check register and budget register on the same page also makes it easier to make adjustment between columns and categories.

There is a still further need for a budget register which is or can easily be tied or related to cash flow and/or cash availability. By combining the budget register portion with the check register and cumulative balance columns, this invention not only allows the user to work with estimated or theoretical budget amounts, but also allows the user to tie the budget amounts to cash availability and cash flow via the integration with the check register.

There is still a further need for such a combined check register and budget register which allows the user to split amounts entered in the check register portion between different budget categories. This invention accomplishes this objective by providing both the check register and the budget register on the same page and allows the check or deposit amount entered in the check register portion to be split among different columns or budget categories so that the split amounts are quickly and easily traced back to the transaction. It is further desirable to have a math check for data entered in the check register against data entered in the budget register.

This invention accomplishes the forenamed objectives and meets the recognized needs while also providing an integrated register which replaces the common personal check register and which gives the user the freedom to use his or her own budget categories or to change those categories.

In addition to the check register and the budget register, this invention provides the user with a savings register to record deposits and withdrawals from savings and other accounts.

The forenamed recognized needs have not heretofore been sufficiently fulfilled by existing checkbooks or budget registers.

The present invention utilizes a combined check register and budget register with a page foldout mechanism to provide both a checkbook register and a budget register on a combination of four facing surfaces or quadrants. This makes it easy and convenient to enter data in the budget register at the same time as data is entered in the check register.

BRIEF DESCRIPTION OF THE DRAWINGS

Preferred embodiments of the invention are described below with reference to the accompanying drawings, which are briefly described below.

FIG. 3 is a schematic which illustrates how the unfolded adjacent pages are divided up for purposes of showing more detail in FIGS. 4A through 4H;

FIG. 5 is a perspective view of one application of the invention wherein each of the adjacent pages are unfolded to expose all four quadrants of the integrated check register and budget register, and wherein the pages are secured about an axis by a spiral mechanism;

FIG. 7 is a perspective view of one application of the invention wherein each of the adjacent pages are tri-folded and unfolded to expose all three sections on one side of each page, wherein each side of a page forms an integrated check register and budget register, and wherein the pages are secured about an axis by a spiral mechanism; and FIG. 8 is a perspective view of one application of the invention wherein the data sheets are tri-folded to form three sections on each side of each page, and illustrates how the plurality of pages can be folded.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection, folding, binding, securing and other means and components utilized in this invention are widely known and used in the field of the invention described, their exact nature or type is not necessary for an understanding and use of the invention by a person skilled in the art or science, and they will not therefore be discussed in significant detail.

Furthermore, the various components shown or described herein for any specific application of this invention can be varied or altered as anticipated by this invention and the practice of a specific application of any element may already be widely known or used in the art or by persons skilled in the art or science and each will not therefor be discussed in significant detail.

Figure 1:
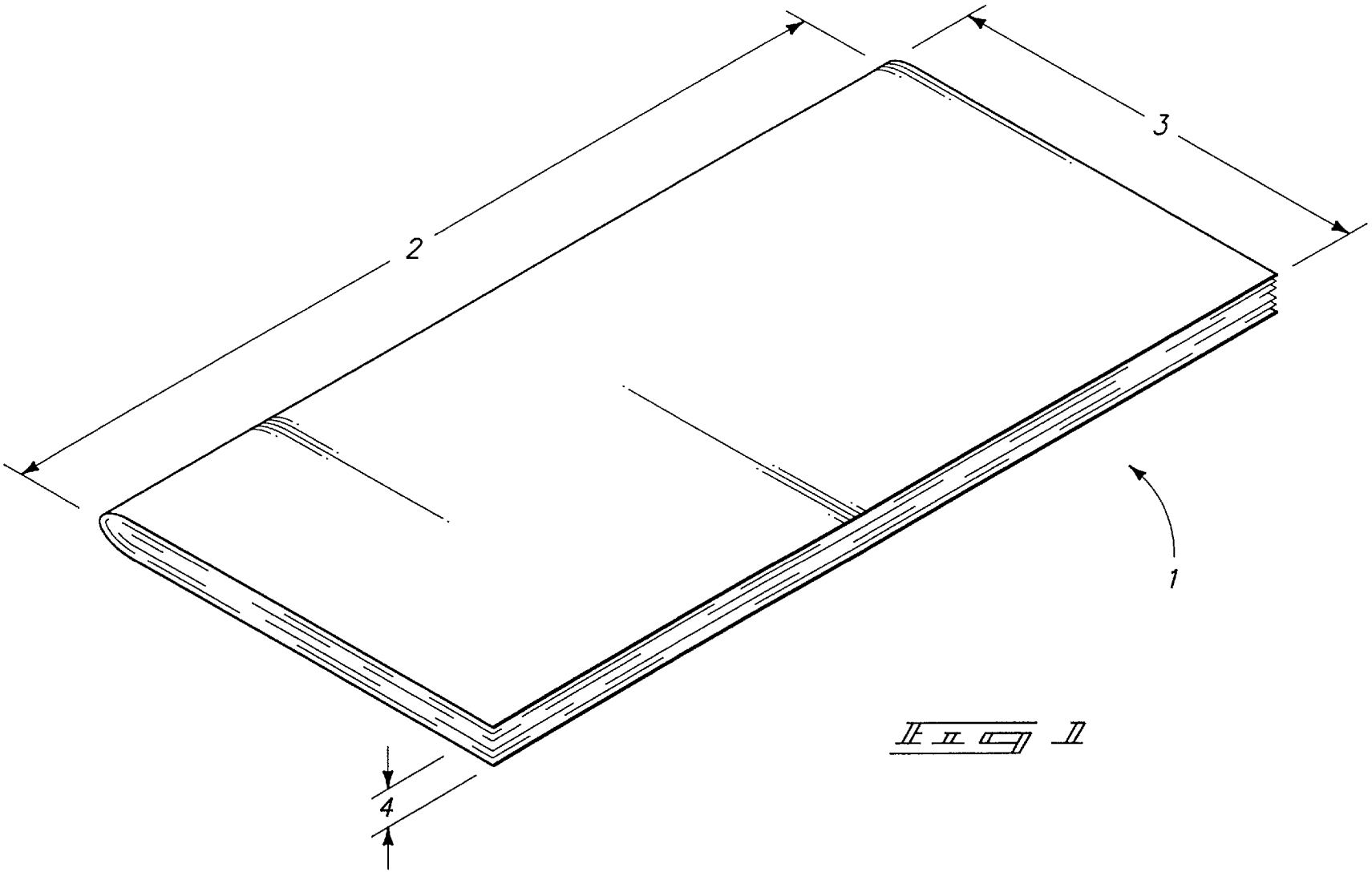
FIG. 1 is a perspective view of a traditionally sized check register which is in a folded position.

FIG. 1 is a perspective view of a traditionally shaped check register 1, having a length 2, a width 3 and a height 4. Typically, the length 2 is six inches and the width 3 is three inches. While there may be variations from the length 2 and width 3 dimensions, the six inch by three inch has become a widely recognized standard size for personal checks and check registers.

While the term register is used in connection with check registers, savings account registers and budget registers, the term is intended to be broadly construed to cover registers, ledgers and other sheets upon which data can be entered in an organized way or in a predetermined way. Furthermore, although the term check registers is used throughout, the invention also applies to other account information, such as savings account registers, credit card account registers and others.

Furthermore, although checking register has been used throughout, the integrated register can also be an integrated savings register or cash register with the budget register.

Figure 2:
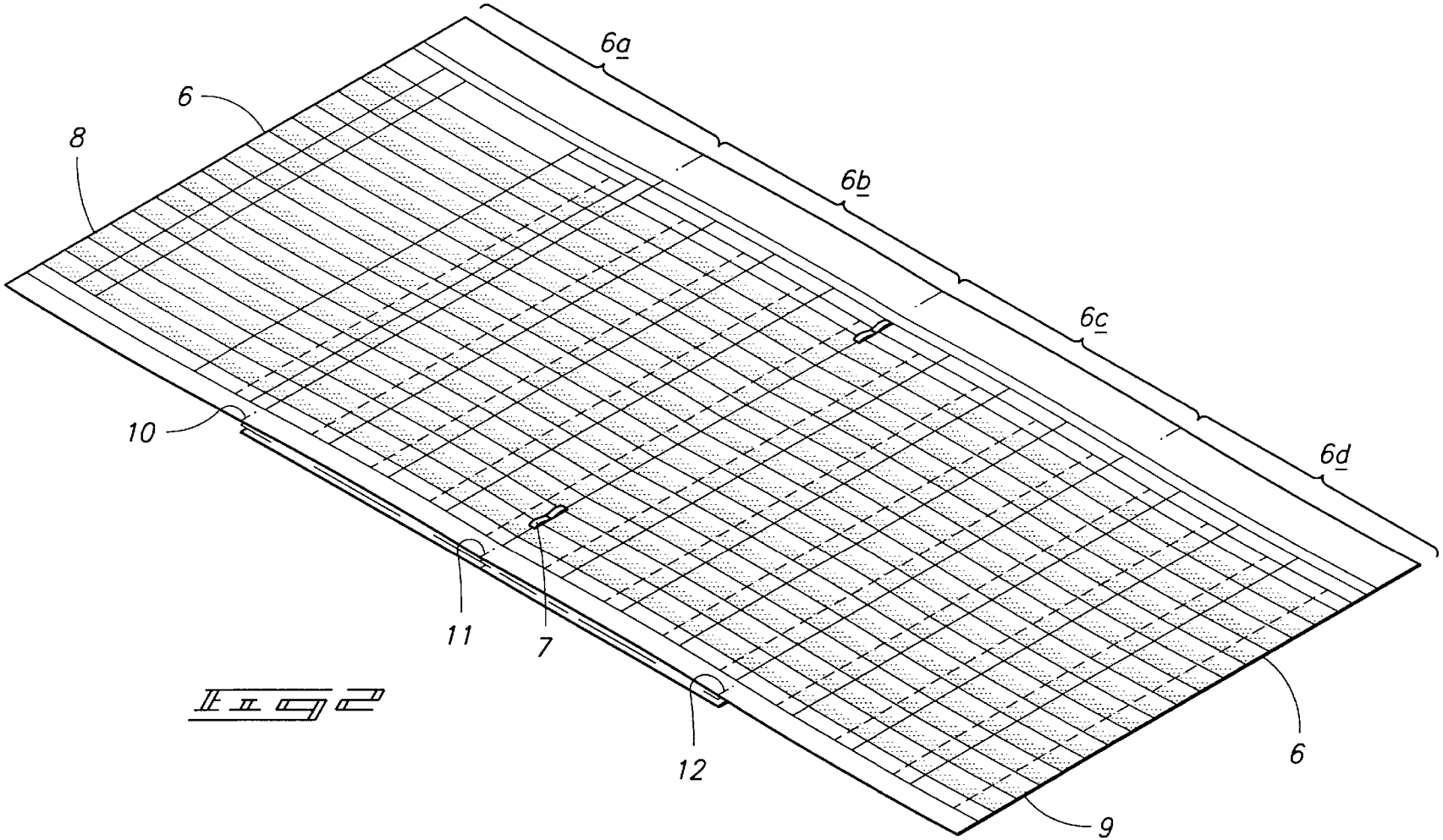
FIG. 2 is a perspective view of one application of the invention wherein each of the adjacent pages are unfolded to expose all four quadrants of the integrated check register and budget register.

FIG. 2 is a perspective view of two adjacent and unfolded pages or data sheets in the combined check register and budget register disclosed by the invention. While two unfolded data sheets combine to form both a check register and a budget register, for ease of reference herein, it will be referred to as an integrated register and designated as item 6 in FIG. 2 and in other figures.

The register or ledger shown in FIG. 2 is defined by longitudinal lines, transverse lines perpendicular to the longitudinal lines and by shading. The important factor is achieving columns and rows and whether that is accomplished by lines and/or shading is not as important as achieving the rows and columns as described.

Figure 6B:
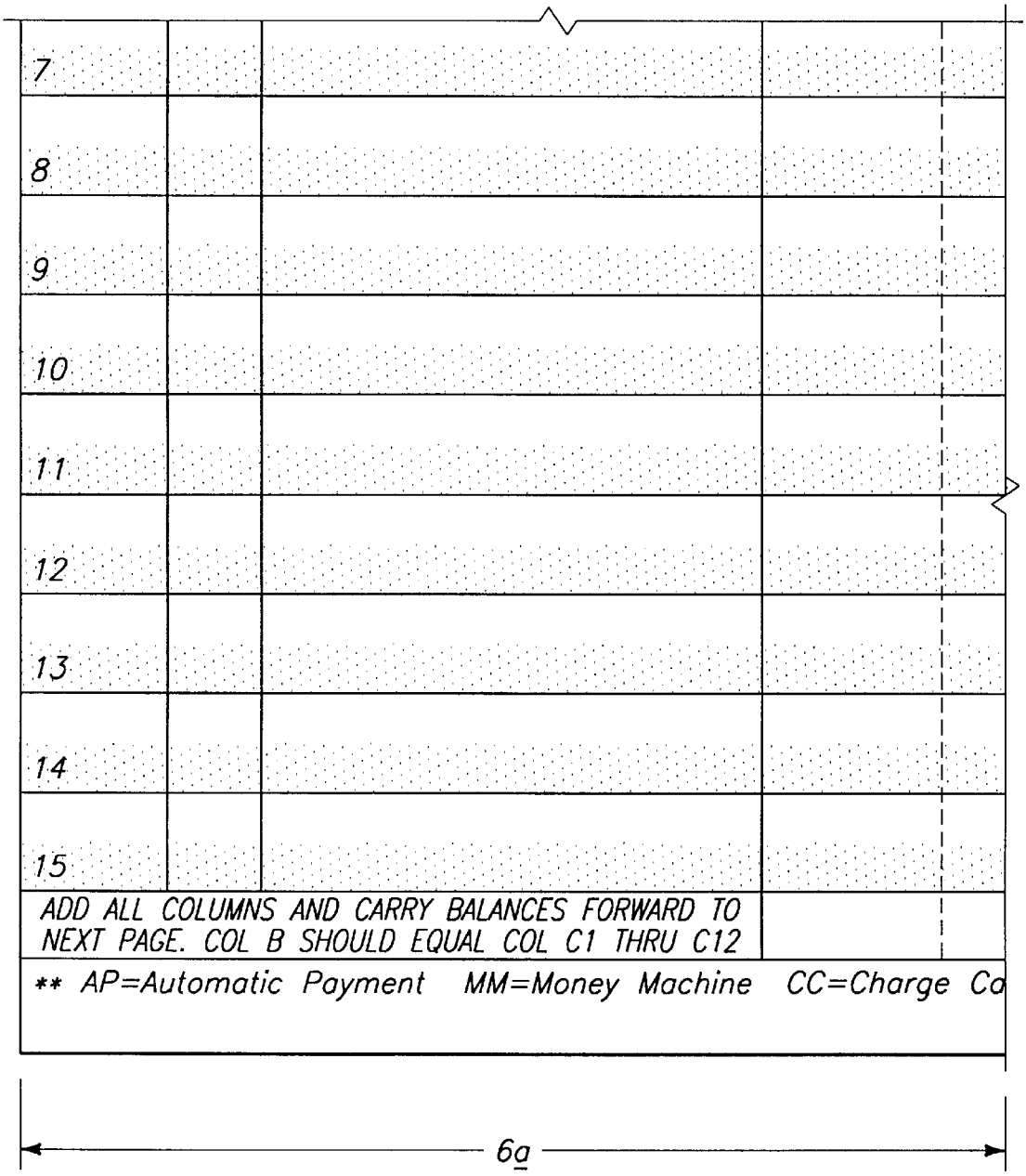
FIG. 6 is a perspective view of one application of the invention illustrating how the plurality of pages can be folded.
Figure 6A:
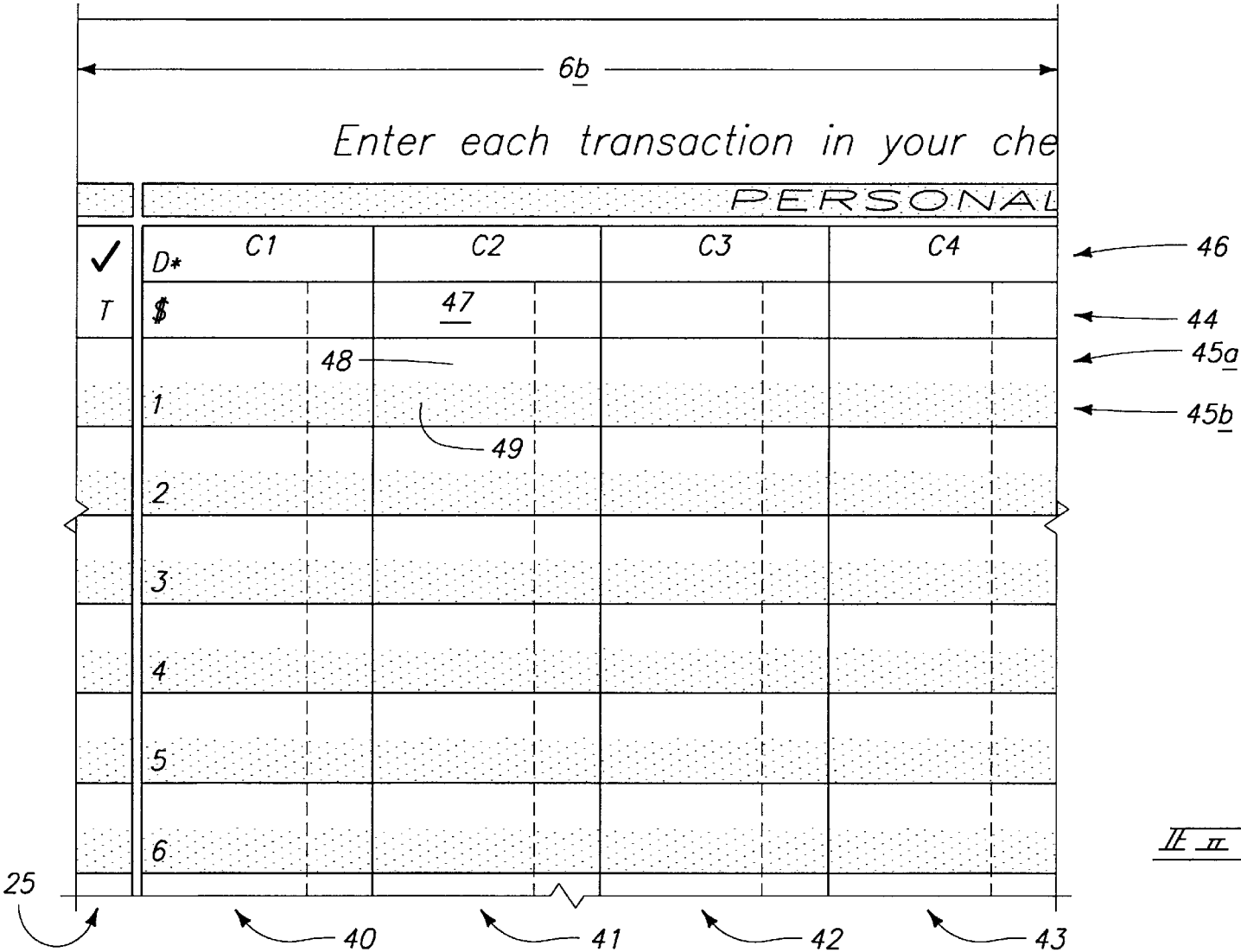
Figure 11:
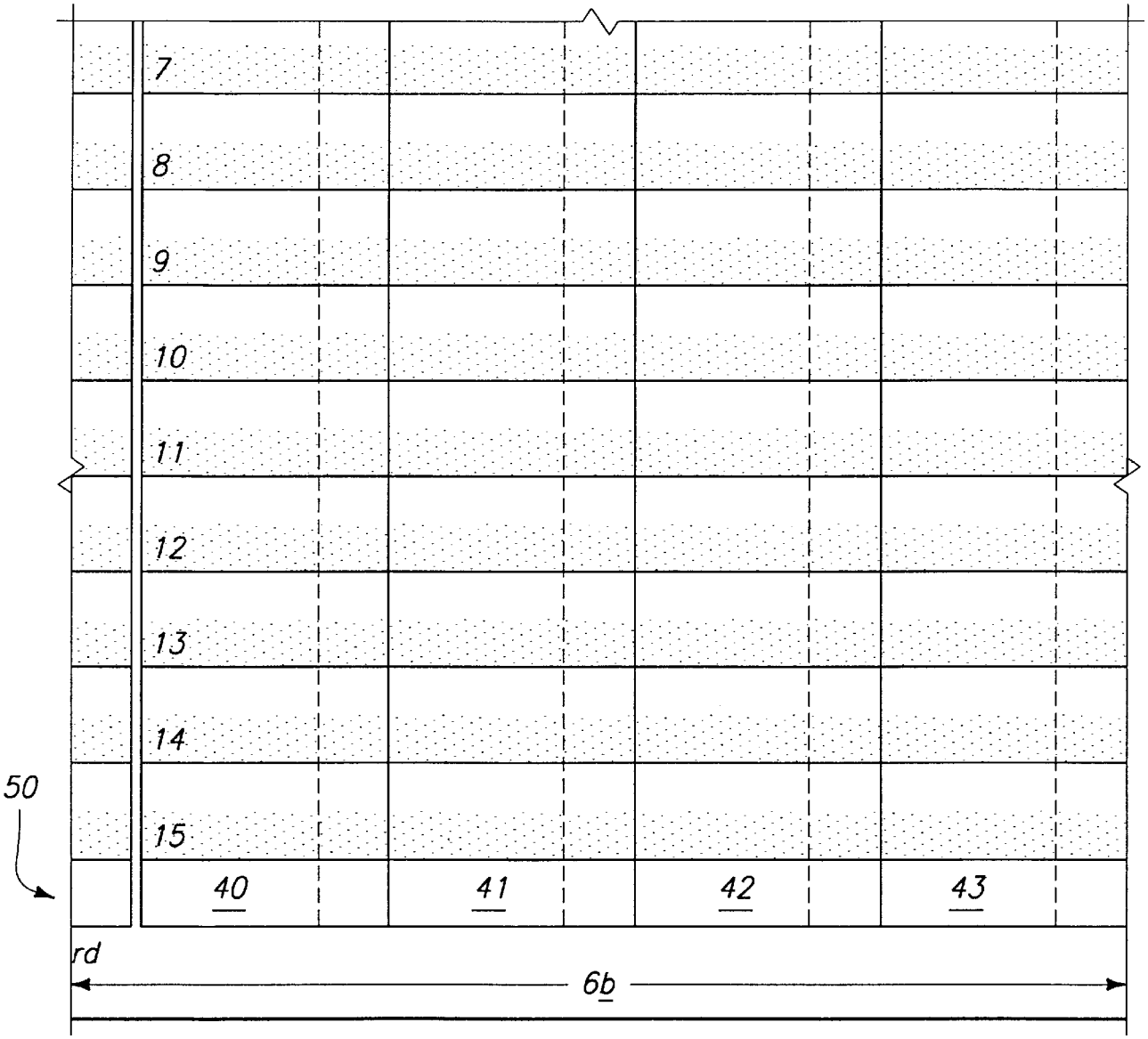
Figure 6C:
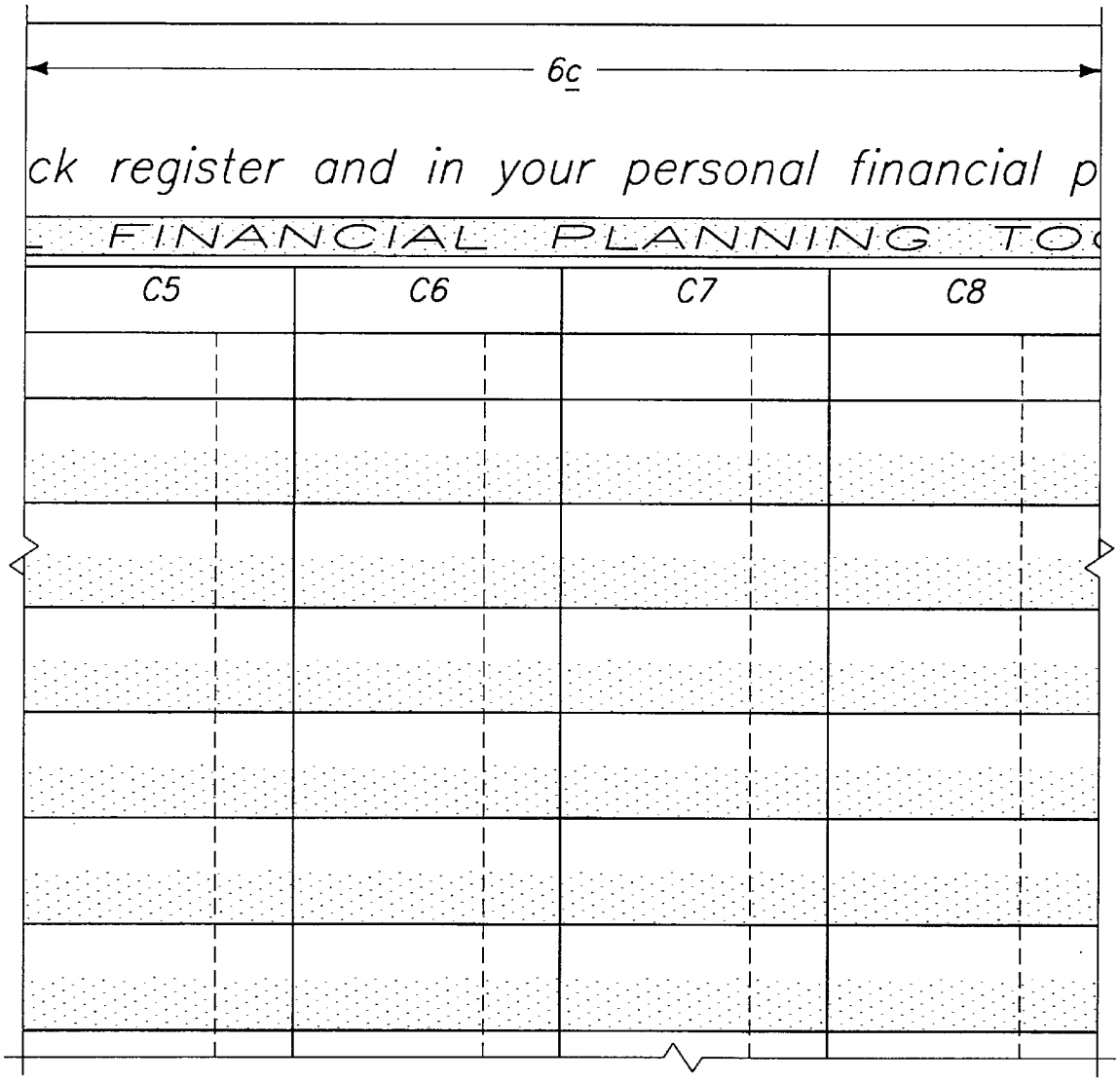

When data is not being entered in the integrated register 6 and all data sheets therein are folded, the integrated register 6 appears to be like any other check register as shown in FIG. 1. The folding of the data sheets is illustrated in FIG. 6.

The integrated register 6 illustrated in FIG. 2 is formed by unfolding a first adjacent data sheet 8 and a second adjacent data sheet 9. In the application of the invention illustrated in FIG. 2, the data sheets are fixed or secured about a central axis by staples 7. When both the first adjacent data sheet 8 and the second adjacent data sheet 9 are unfolded, four quadrants are created by the three axis, i.e. axis 10, axis 11 and axis 12. The four quadrants are labeled as quadrant 6*a*, quadrant 6*b*, quadrant 6*c* and quadrant 6*d*. The first adjacent data sheet 8 includes quadrants 6*a* and 6*b* while the second adjacent data sheet 9 includes quadrants 6*c* and 6*d*.

The two quadrants 6*a* and 6*b* from the first adjacent data sheet 8 combined with the two quadrants 6*c* and 6*d* from a facing side of adjacent data sheet 9, form a check register and a budget register.

On any given adjacent data sheets, axis 10 and axis 12 will each constitute a fold axis or axis created by a fold in the paper or sheet on which the register is printed or otherwise imparted. Axis 11 is the axis about which all data sheets in the integrated register 6 are rotatably fixed. Therefore, quadrant 6*a* and quadrant 6*b* for any given integrated ledger data sheet will physically be on or part of the same data sheet, as will quadrants 6*c* and 6*d* be on the same data sheet. Depending on how the register is constructed however, quadrants 6*a* and 6*b* will generally not be on the same continuous piece of paper as quadrants 6*c* and 6*d*.

While there are other configurations for integrating a check register and budget register as contemplated by this invention, in the preferred embodiment and as further shown in FIG. 4A through FIG. 4H, the check register is preferably substantially contained in quadrant 6*a* and the budget register is substantially contained in quadrants 6*b*, 6*c* and 6*d*.

FIG. 3 is a schematic and reference for the identification of the location from which FIGS. 4A through 4H are taken. For illustration purposes, the quadrants and axis have also been shown in FIG. 3.

Figure 4A:
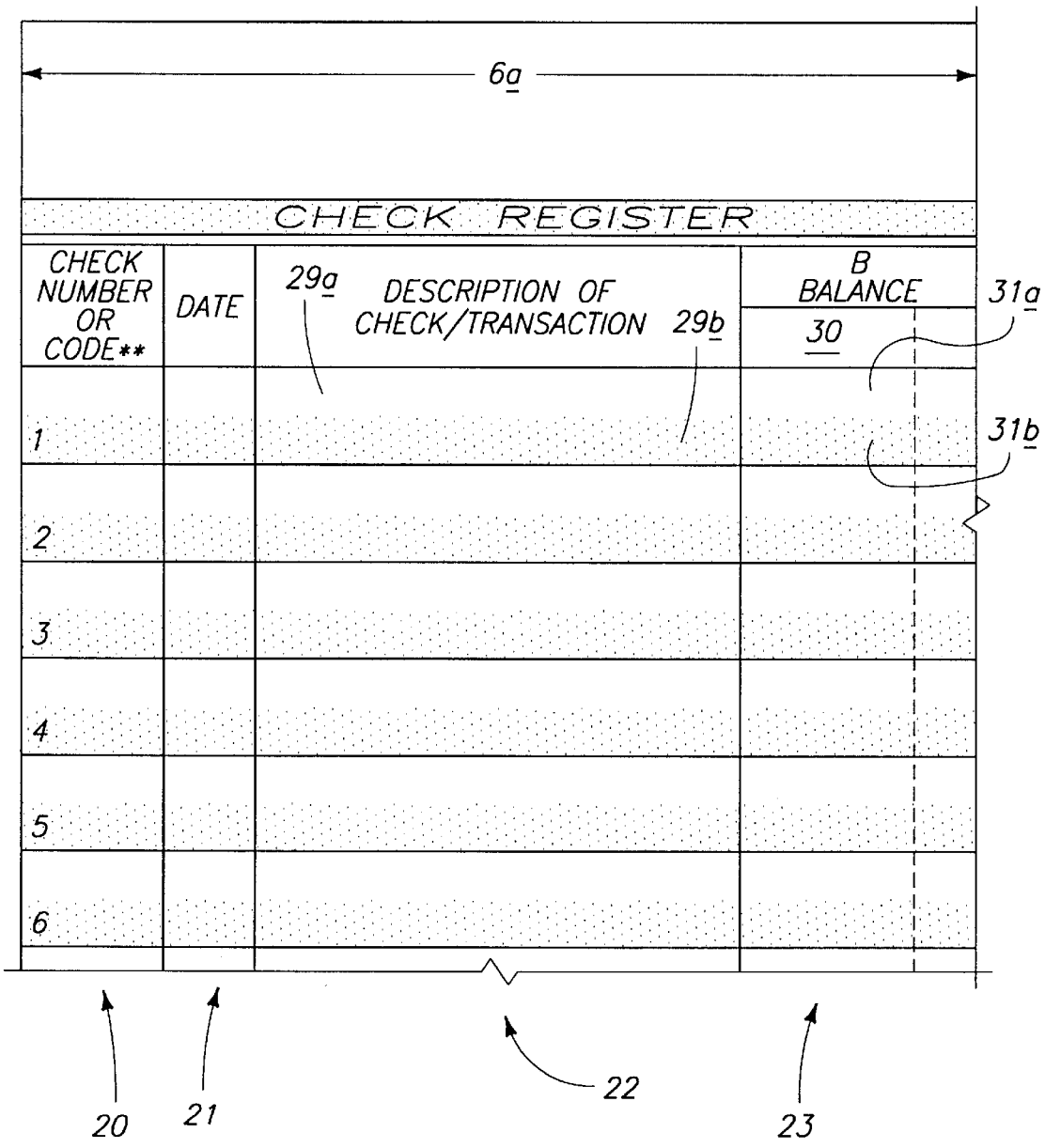
FIG. 4A is a plan view of the upper portion of the first quadrant of one application of this invention, which is the upper portion of the quadrant containing the check register.

FIG. 4A shows a detail of the upper portion of quadrant 6*a* and shows column headings that can be used as the check register portion of the integrated register. Data entry on check registers, a sample of which is shown in FIG. 4A is typically by row, i.e. data for a given transaction is entered on the same horizontal row. Vertical columns are provided for the entry of desired data pertaining to each individual transaction entered in each row.

In FIG. 4A for example, column 20 is a column for entry of the check number or code number for the data entered on a given row for a transaction. Column 20 being the left-most column, may also be used to imprint a row or transaction number for the user's reference.

Column 21 is for entry of the date of the transaction and column 22 is for the entry of a description of the transaction.

It should be noted that in the preferred embodiment the transaction column 22 is vertically divided into two sub-rows, the upper row 29*a* and the lower row 29*b*. Although the lower row 29*b* is visually distinguished from the upper row 29*a* by shading in FIG. 4A, it can also be distinguished by lines and numerous other means.

An example of an entry for the writing of a check may include the payee of the check in column 22 along with a description of what the check was written for. An example of data that may be entered in column 22 may be the entry of "National Bank" in the upper row 29*a* of a column 22 transaction and "mortgage payment" in the lower row 29*b* of column 22 to indicate that a payment was made to National Bank as a mortgage payment.

Column 23 in FIG. 4A is a column for the entry of the dollar amount of the transaction. In the preferred embodiment, column 23 is for the entry of both the transaction amount in upper row 31*a* and for the entry of the running or cumulative balance in the account in lower row 31*b*. The starting balance for the account before entry of any transactions is made in space 30.

When a transaction is made in the first row for example, the amount of that transaction is entered in space 31*a* and the amount so entered is then added or subtracted from the beginning balance amount entered in space 30 to arrive at the new balance after the transaction, which can be entered in space 31*b*. Space 31*b* is indicated as the lower shaded row portion of the first transaction row in FIG. 4A.

This data entry procedure and computation of the running balance is followed as additional transactions are entered and a running or cumulative balance is thereby maintained.

Column 25 in FIG. 4C can be utilized in a number of different ways by persons in their check register or using this invention. Oftentimes for instance it is utilized to indicate that a check has been received and processed on a statement from the bank and therefore included in the computation of the account balance by the bank.

FIG. 4B shows a detail of the lower portion of quadrant 6*a*, which includes more rows for the entry of transactions. A typical check register may also have a list of acronyms or other instructions at the bottom of each data sheet, as illustrated at the bottom of FIG. 4B.

FIG. 4C shows a detail of the upper portion of quadrant 6*b*, which is the start of the second quadrant, quadrant 6*b*, and the start of the budget register portion of the integrated register 6. Column 40 as the first column in the budget register portion of the integrated register, may contain insignia representing the row number or letter as desired. Column 40 may also be imprinted with a row number which corresponds to the row number imprinted in column 20 as illustrated in FIGS. 4A and 4B and with the row number imprinted in column 60 as illustrated in FIGS. 4G and 4H.

FIG. 4C illustrates that the budget register portion includes a plurality of columns, i.e. columns 40, 41, 42 and 43, for the entry of data by the user. A name or other indicia of the category or budget classification can be entered in the space below the column designations, as indicated by the row of space identified as row 46 in FIG. 4C. In FIG. 4C, column 40 is designated as C1, column 41 as C2, column 42 as C3 and column 43 as C4.

Row 44 in FIG. 4C is utilized to enter the beginning balance or amount for that particular budget category or classification. Subsequent transactional rows can include an upper row 45*a* and a lower row 45*b*. The transactional amount can be entered in the upper row 45*a*, and then to maintain a running or cumulative balance for the budget category, the transactional amount entered in upper row 45*a* can then be added or subtracted from the beginning balance to arrive at the running or cumulative balance. This process is repeated as additional transactions are entered on the integrated register.

The amount(s) entered in the budget categories correspond to the amount entered in the check register portion of the register. For instance, if a check is written for an expense which falls within the budget category identified in column 41 (also labeled C2), then the full amount of the check can also be entered in space 48, subtracted from the beginning balance or budget entered in space 47, to arrive at the running or cumulative balance to then be entered in space 49. The running balance entered in space 49 then serves as the beginning balance for the next transaction entered in column 41.

This same procedure can be followed for all columns and rows in the budget register.

The amount written in the check or savings register may also be split between two or more budget categories.

FIG. 4D shows a detail of the lower portion of quadrant 6*b* and the same procedure for the transactional rows can be followed for the rows shown in FIG. 4D. When the four quadrant data sheet comprising the integrated register is full of transactions, the bottom row 50 can be utilized to enter the ending balance for each budget column or category for entry as the beginning balance on the next integrated register data sheet.

Figure 4F:
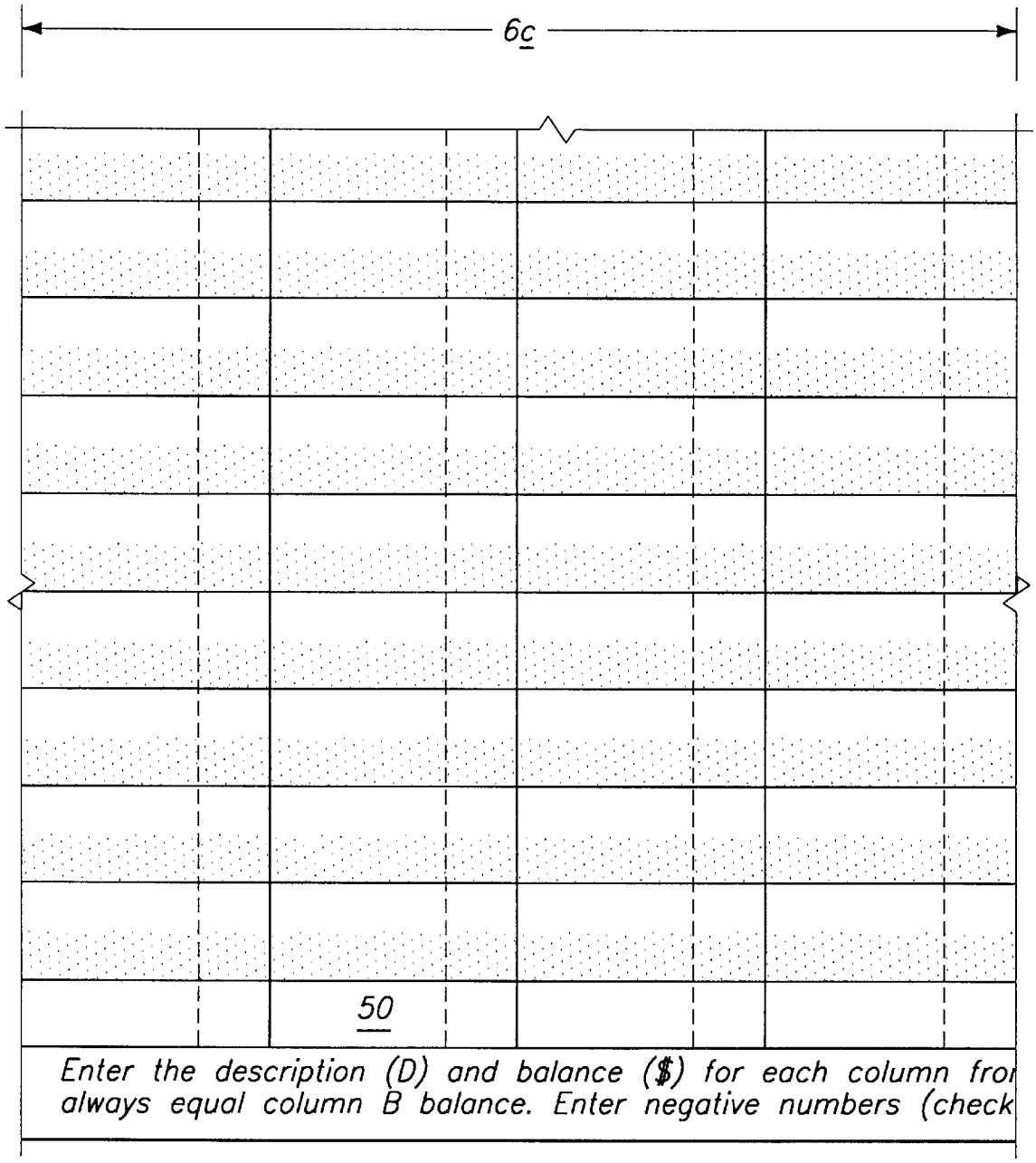
FIG. 4F is a plan view of the lower portion of the third quadrant of one application of this invention, which is the lower portion of a quadrant containing a portion of the budget register.
Figure 4:
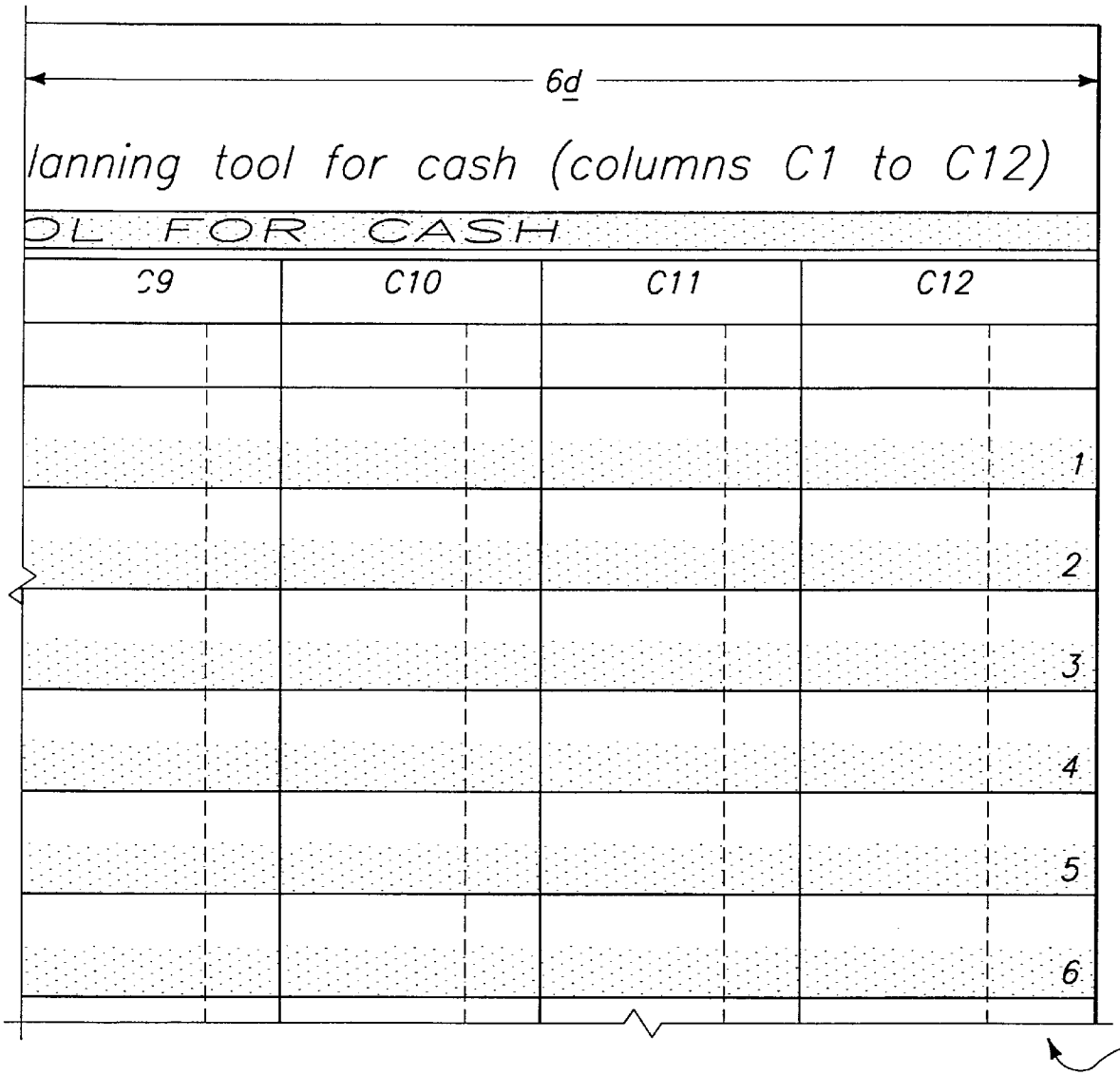
FIG. 4B is a plan view of the lower portion of the first quadrant of one application of this invention, which is the lower portion of the quadrant containing the check register.
FIG. 4C is a plan view of the upper portion of the second quadrant of one application of this invention, which is the upper portion of a quadrant containing a portion of the budget register.
FIG. 4D is a plan view of the lower portion of the second quadrant of one application of this invention, which is the lower portion of a quadrant containing a portion of the budget register.
FIG. 4E is a plan view of the upper portion of the third quadrant of one application of this invention, which is the upper portion of a quadrant containing a portion of the budget register.
FIG. 4G is a plan view of the upper portion of the fourth quadrant of one application of this invention, which is the upper portion of a quadrant containing a portion of the budget register.
FIG. 4H is a plan view of the lower portion of the fourth quadrant of one application of this invention, which is the lower portion of a quadrant containing a portion of the budget register.
Figure 4H:
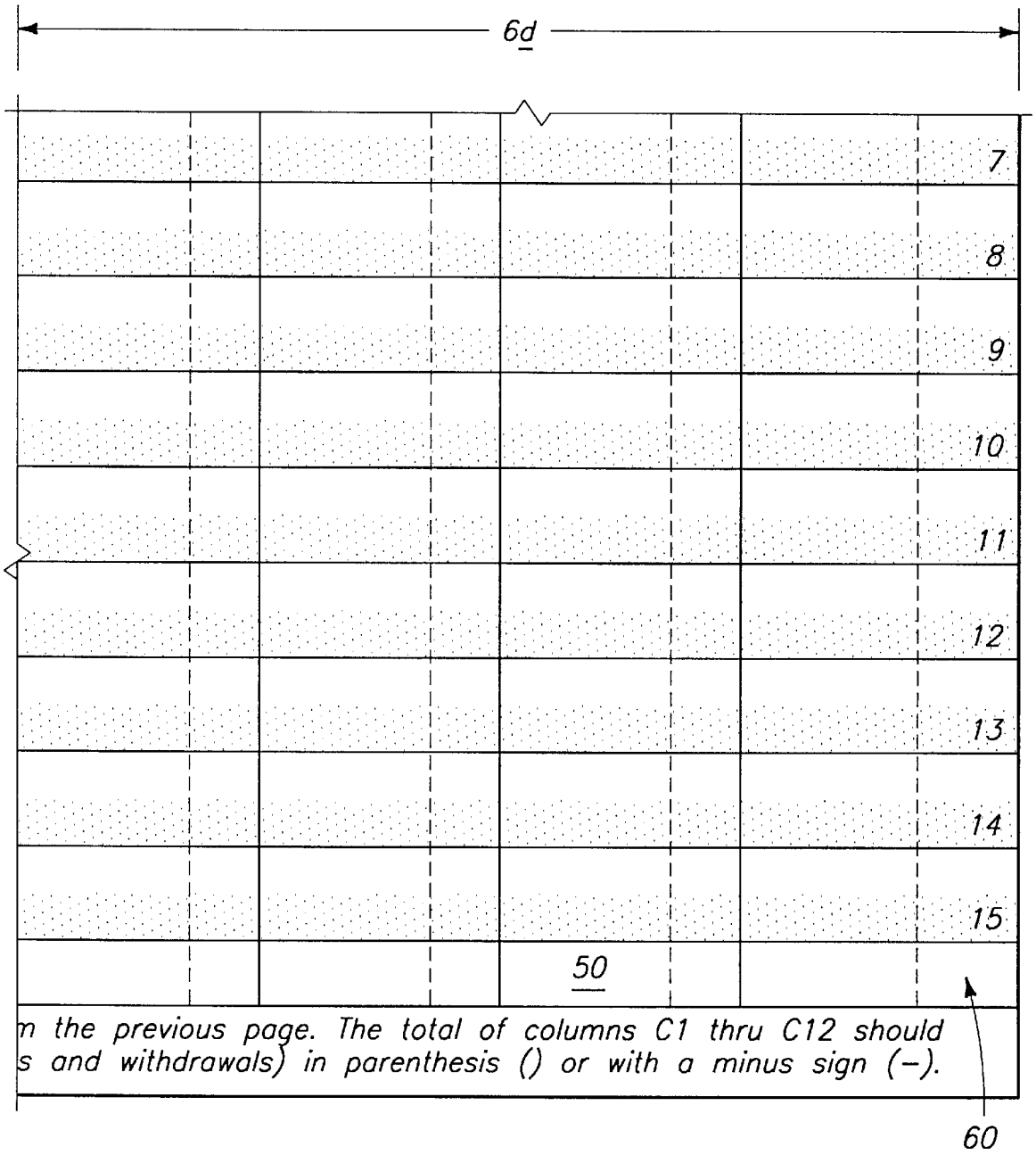
Figure 11:
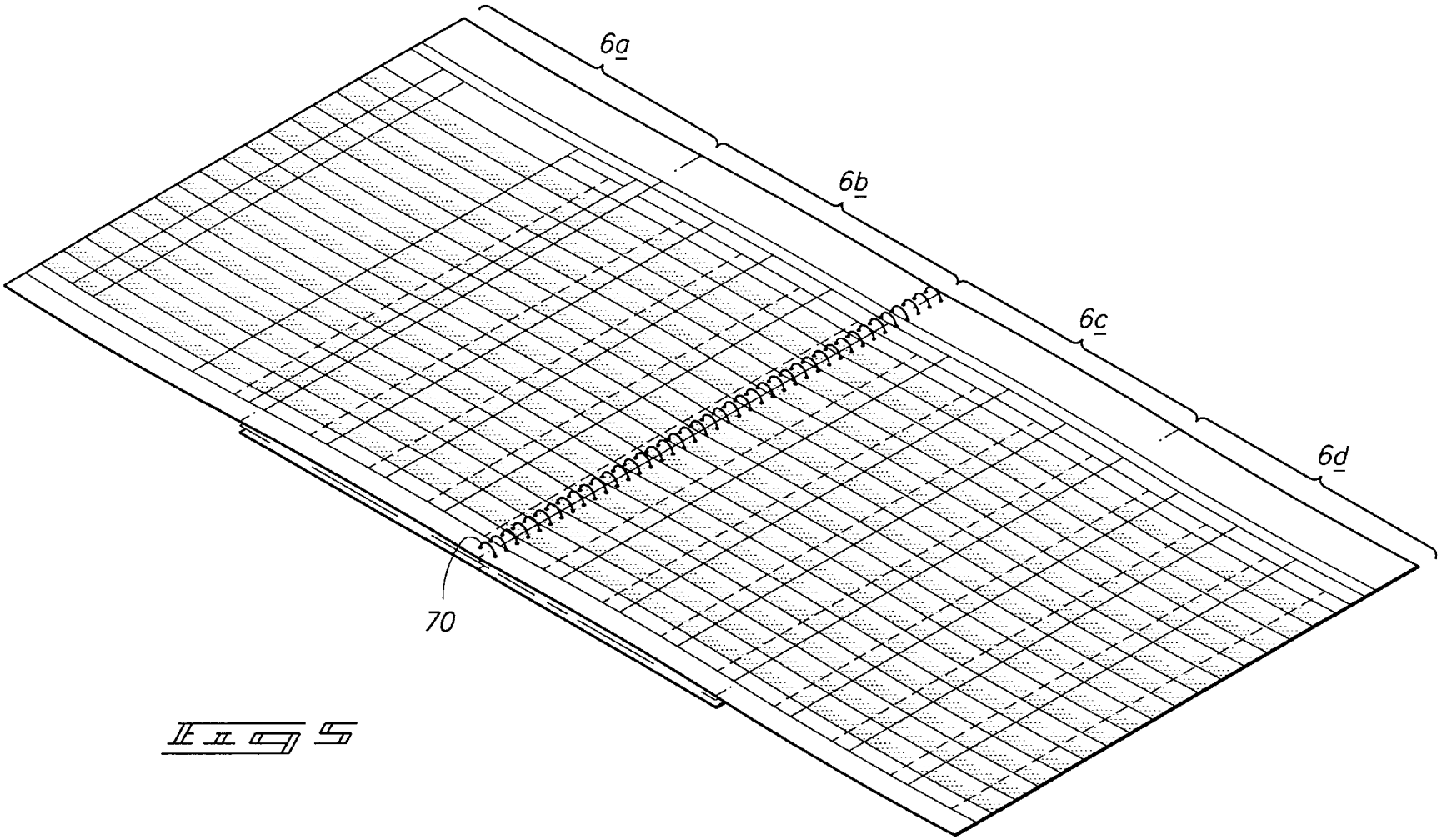
Figure 11:
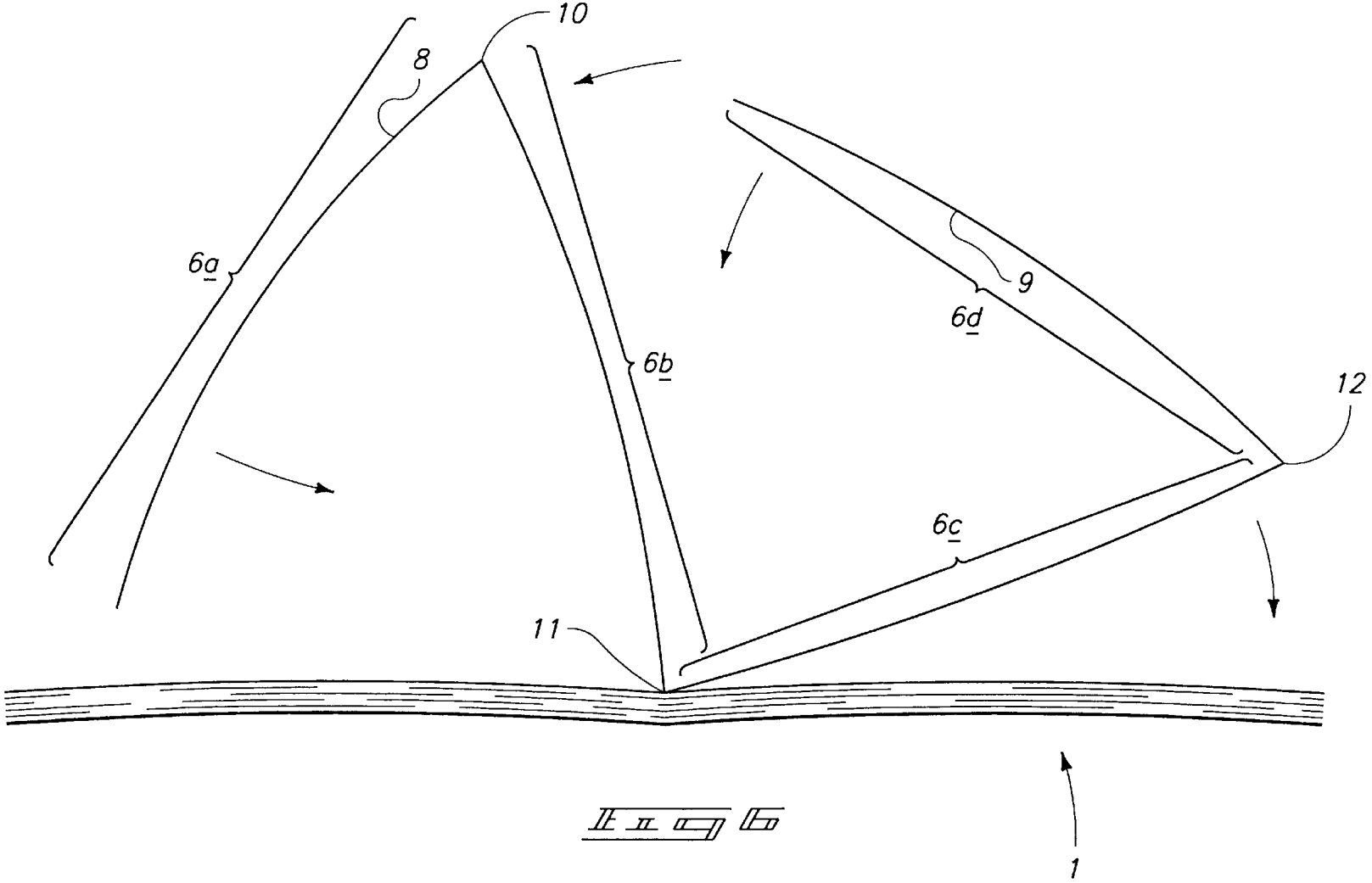
Figure 11:
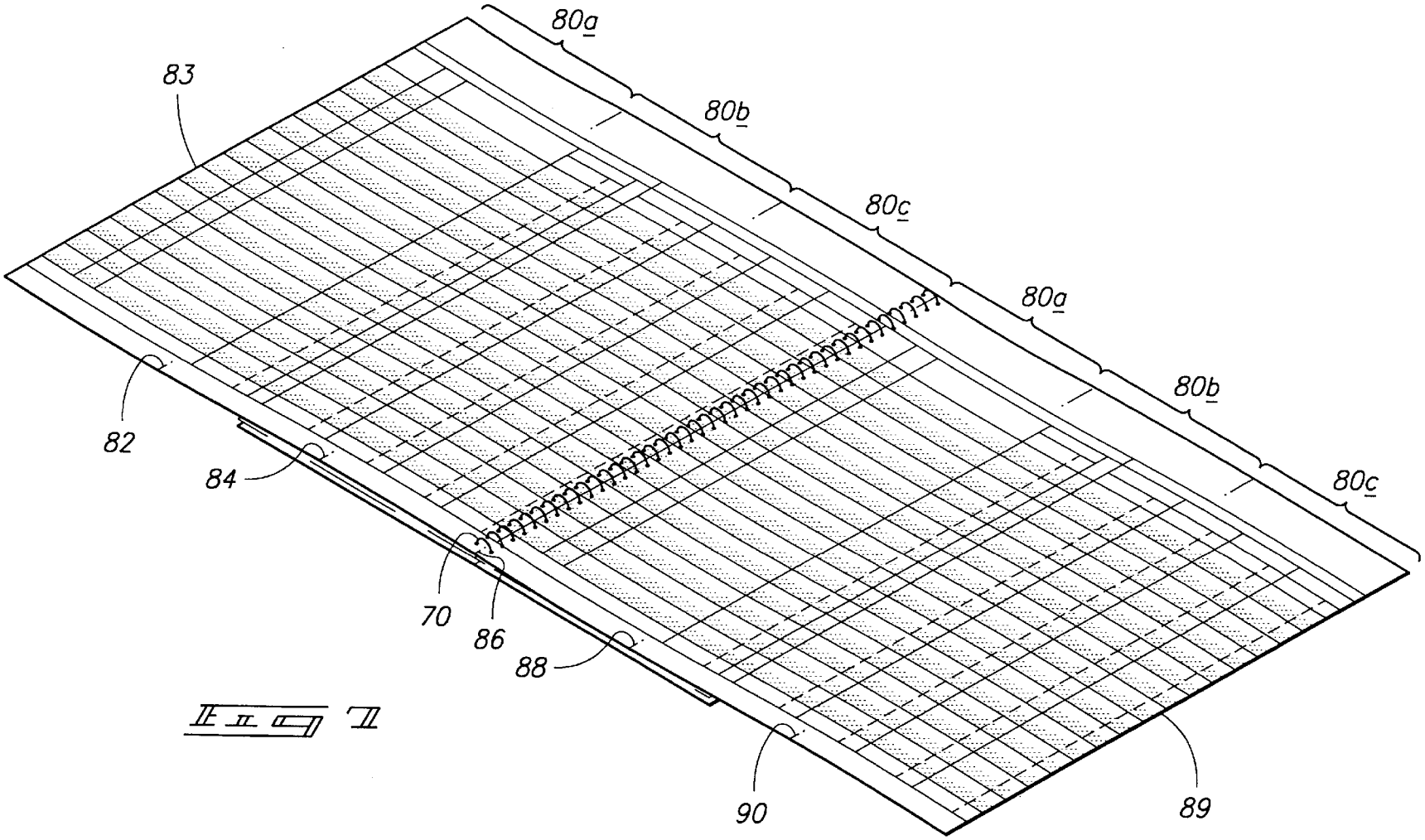
Figure 18:
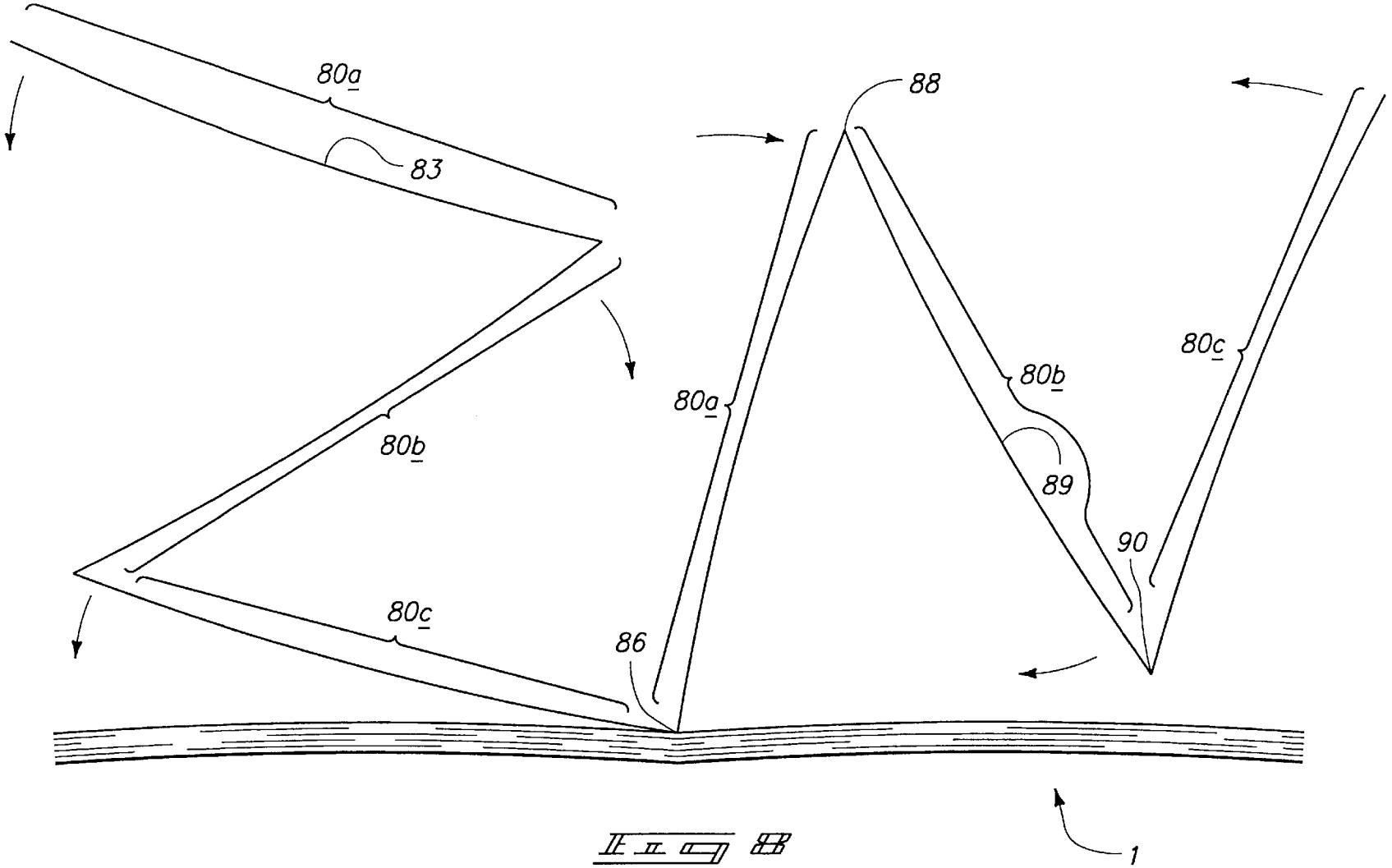

FIG. 4E shows a detail of the upper portion of quadrant 6*c* and FIG. 4F shows a detail of the lower portion of quadrant 6*c*. The columns shown in FIGS. 4E and 4F are utilized the same as for the columns illustrated in FIGS. 4C and 4D.

FIG. 4G shows a detail of the upper portion of quadrant 6*d* and FIG. 4H shows a detail of the lower portion of quadrant 6*d*. The columns shown in FIGS. 4G and 4H are utilized the same as for the columns illustrated in FIGS. 4C and 4D. Since the right edge of the budget register, as shown in FIGS. 4G and 4H, includes the last column, the right-most portion of column 60 may be utilized to imprint a row number. The row number imprinted in column 60 should be consistent with the row number entered on the left-most side of the budget register portion, as shown in column 40 in FIG. 4C and FIG. 4D and in column 20 in FIG. 4A and 4B.

FIG. 5 is a perspective view of two adjacent and unfolded data sheets in the combined check register and budget register disclosed by the invention and as also illustrated in FIG. 2. In the application of the invention illustrated in FIG. 5 however, the data sheets are rotatably fixed or secured about a central axis by a spiral joiner 70. There are numerous ways within the contemplation of this invention by which the data sheets can be rotatably secured about a central axis.

FIG. 6 is a perspective view of one application of the invention illustrating how the plurality of data sheets can be folded. Although FIG. 6 shows all the data sheets folded longitudinally in the same direction, the direction of the fold can be either way and all data sheets need not be folded in the same direction.

FIG. 6 also illustrates the location of the four quadrants, quadrants 6*a*, 6*b*, 6*c* and 6*d*, which are also reflected in FIG. 2. The three axis about which the various quadrants are rotated, axis 10, axis 11 and axis 12 are also shown.

Preferably each quadrant of the integrated register is approximately three inches by six inches to fit the typical check register size. Therefore, when two adjacent data sheets are unfolded, the resulting integrated register is approximately six inches by twelve inches.

Printing on both sides of each data sheet easily allows twenty five or more four quadrant integrated register data sheets to be included in a register without having too great of a height 4.

Since the check register can also be a savings or cash register, the application shown in FIGS. 4A through 4H can also be used as a cash or savings register with minor changes in language and format. The specific format of the columns and rows which comprise the checking register, savings register, cash register or budget register is not important as there are many variations within the contemplation of the invention.

FIG. 7 illustrates one application of the invention wherein each of the adjacent data sheets are tri-folded to form three sections, 80*a*, 80*b* and 80*c*, on each side of each of the plurality of data sheets. FIG. 7 illustrates first adjacent data sheet 83 and a second adjacent data sheet 89.

In the application of the invention illustrated in FIG. 7, one side of each data sheet forms an integrated check register and budget register. There are two fold axis on each data sheet, i.e. axis 82 and axis 84 on the first data sheet, center axis 86, and axis 88 and axis 90 on the second data sheet 89.

FIG. 7 also shows each data sheet secured about an axis by a spiral mechanism 70.

FIG. 8 shows the application of the invention also shown in FIG. 7 wherein each data sheet is tri-folded into three sections, i.e. two folds in each data sheet or data sheet. FIG. 8 further illustrates how the plurality of data sheets can be folded.

FIG. 8 also illustrates the location of the three sections, sections 80*a*, 80*b* and 80*c*, which are also reflected in FIG. 7 and the axis about which the various sections are rotated, axis 82, axis 84, axis 88 and axis 90 are also shown.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A register for recording check data and budget data, comprising:

a. a plurality of data sheets secured about a central axis;

i. each data sheet having longitudinal columns on both sides and transverse rows perpendicular to said longitudinal columns, said longitudinal columns and transverse rows forming part or all of a register;

ii. each data sheet having two longitudinal folds one of which divide one side of the data sheet into two quadrants; and the other of which divides the other side of the data sheet into two quadrants;

iii. each transverse row including two visually distinct sub-rows, an upper sub-row and a lower sub-row, wherein the lower sub-row is to be utilized to enter a running balance of figures entered in the applicable longitudinal column;

such that two quadrants from one side of a data sheet combined with two quadrants from a facing side of an adjacent data sheet form a check register and a budget register, for separate entry of check data and budget data, wherein the check register is positioned on the data sheet such that it is available for use when the data sheet is in a folded or in an unfolded position.

2. A register for recording check data and budget data, as recited in claim 1, and in which the plurality of data sheets are secured about the central axis in book-like fashion.

3. A register for recording check data and budget data, as recited in claim 1, and in which the plurality of data sheets are secured about a central axis by a spiral joiner.

4. A register for recording check data and budget data, as recited in claim 1, and in which the check register portion is substantially contained in one of the four quadrants formed by the folds on each data sheet.

5. A register for recording savings account data and budget data, comprising:

b. a plurality of data sheets secured about a central axis;

i. each data sheet having longitudinal columns on both sides and transverse rows perpendicular to said longitudinal columns, said longitudinal columns and transverse rows forming part or all of a register;

ii. each data sheet having two longitudinal folds one of which divide one side of the data sheet into two quadrants, and the other of which divides the other side of the data sheet into two quadrants;

iii. each transverse row including two visually distinct sub-rows, an upper sub-row and a lower sub-row, wherein the lower sub-row is to be utilized to enter a running balance of figures entered in the applicable longitudinal column;

such that two quadrants from one side of a data sheet combined with two quadrants from a facing side of an adjacent data sheet form a saving register and a budget register, for separate entry of check data and budget data, wherein the check register is positioned on the data sheet such that it is available for use when the data sheet is in a folded or in an unfolded position.

6. A register for recording checking account data and budget data, comprising:

a. a plurality of data sheets secured about a central axis;

i. each data sheet having longitudinal columns on both sides and transverse rows perpendicular to said longitudinal columns, said longitudinal columns and transverse rows on one side of each data sheet forming a register;

ii. each data sheet having two longitudinal folds on each side of the data sheet, the two folds on each of said sides dividing each of said sides of the data sheet into three sections;

iii. each transverse row including two visually distinct sub-rows, an upper sub-row and a lower sub-row, wherein the lower sub-row is to be utilized to enter a running balance of figures entered in the applicable longitudinal column;

such that the three sections from one side of a data sheet combine with the three sections from the other side of the data sheet to form a check register and a budget register, for separate entry of check data and budget data, wherein the check register is positioned on the data sheet such that it is available for use when the data sheet is in a folded or in an unfolded position.

7. A register for recording savings account data and budget data, comprising:

a. a plurality of data sheets secured about a central axis;

i. each data sheet having longitudinal columns on both sides and transverse rows perpendicular to said longitudinal columns, said longitudinal columns and transverse rows on one side of each data sheet forming a register;

ii. each data sheet having two longitudinal folds on each side of the data sheet, the two folds on each of said sides dividing each of said sides of the data sheet into three sections;

iii. each transverse row including two visually distinct sub-rows, an upper sub-row and a lower sub-row, wherein the lower sub-row is to be utilized to enter a running balance of figures entered in the applicable longitudinal column;

such that the three sections from one side of a data sheet combined with the three sections from the other side of the data sheet to form a saving register and a budget register, for separate entry of check data and budget data, wherein the savings register is positioned on the data sheet such that it is available for use when the data sheet is in a folded or in an unfolded position.

8. A process for the entry of data in a register for recording both check data and budget data, comprising the following steps:

a. providing a plurality of data sheets secured about a central axis;

b. providing each data sheet with longitudinal columns on both sides and transverse rows perpendicular to said longitudinal columns, said longitudinal columns and transverse rows forming part or all of a register, and each transverse row including two visually distinct sub-rows, an upper sub-row and a lower sub-row, wherein the lower sub-row is to be utilized to enter a running balance of figures entered in the applicable longitudinal column;

c. providing each data sheet with two longitudinal folds one of which divide one side of the data sheet into two quadrants, and the other of which divides the other side of the data sheet into two quadrants;

d. providing the plurality of data sheets secured about a central axis such that two quadrants from a side of a data sheet combined with two quadrants from a facing side of an adjacent data sheet form a check register and a budget register, wherein the check register is positioned on the data sheet such that it is available for use when the data sheet is in a folded or in an unfolded position;

e. unfolding a first data sheet; and f. unfolding a data sheet adjacent to the first data sheet, thereby exposing both a check register and a budget register.

9. A process as recited in claim 8, and further comprising the following steps:

a. entering data into the check register and entering corresponding data into the budget register.

10. A process for entry of data in a register for recording both savings data and budget data, comprising the following steps:

a. providing a plurality of data sheets secured about a central axis;

b. providing each data sheet with longitudinal columns on both sides and transverse rows perpendicular to said longitudinal columns, said longitudinal columns and transverse rows forming part or all of a register, and each transverse row including two visually distinct sub-rows, an upper sub-row and a lower sub-row, wherein the lower sub-row is to be utilized to enter a running balance of figures entered in the applicable longitudinal column;

c. providing each data sheet with two longitudinal folds, one of which divides one side of the data sheet into two quadrants and the other of which divides the other side of the data sheet into two quadrants;

d. providing the plurality of data sheets secured about a central axis such that two quadrants from a side of a data sheet combined with two quadrants from a facing side of an adjacent data sheet form a savings register and a budget register, wherein the savings register is positioned on the data sheet such that it is available for use when the data sheet is in a folded or in an unfolded position;

e. unfolding a first data sheet; and f. unfolding a data sheet adjacent to the first data sheet, thereby exposing both a savings register and a budget register.

11. A process for the entry of data in a register for recording both check data and budget data, comprising the following steps:

a. providing a plurality of data sheets secured about a central axis;

b. providing each data sheet with longitudinal columns on both sides and transverse rows perpendicular to said longitudinal columns, said longitudinal columns and transverse rows forming part or all of a register, and each transverse row including two visually distinct sub-rows, an upper sub-row and a lower sub-row, wherein the lower sub-row is to be utilized to enter a running balance of figures entered in the applicable longitudinal column;

c. providing each data sheet with two longitudinal folds on each side of the data sheet, the two folds on each of said sides dividing each of said sides of the data sheet into three sections;

d. providing the plurality of data sheets secured about a central axis such that two quadrants from a side of a data sheet combined with two quadrants from a facing side of an adjacent data sheet form a check register and a budget register, wherein the check register is positioned on the data sheet such that it is available for use when the data sheet is in a folded or in an unfolded position;

e. unfolding a first data sheet; and f. unfolding a data sheet adjacent to the first data sheet, thereby exposing both a check register and a budget register.

12. A process for the entry of data in a register for recording both savings data and budget data, comprising the following steps;

a. providing a plurality of data sheets secured about a central axis;

b. providing each data sheet with longitudinal columns on both sides and transverse rows perpendicular to said longitudinal columns, said longitudinal columns and transverse rows forming part or all of a register, and each transverse row including two visually distinct sub-rows, an upper sub-row and a lower sub-row, wherein the lower sub-row is to be utilized to enter a running balance of figures entered in the applicable longitudinal column;

c. providing each data sheet with two longitudinal folds on each side of the data sheet, the two folds on each of said sides dividing each of said sides of the data sheet into three sections;

d. providing the plurality of data sheets secured about a central axis such that two quadrants from a side of a data sheet combined with two quadrants from a facing side of an adjacent data sheet form a savings register and a budget register, wherein the savings register is positioned on the data sheet such that it is available for use when the data sheet is in a folded or in an unfolded position;

e. unfolding a first data sheet; and f. unfolding a data sheet adjacent to the first data sheet, thereby exposing both a savings register and a budget register.

* * * * *